US007658374B2

(12) United States Patent
Yasukawa et al.

(10) Patent No.: US 7,658,374 B2
(45) Date of Patent: Feb. 9, 2010

(54) SHEET FEEDER

(75) Inventors: Ryoichi Yasukawa, Kahoku (JP); Minoru Masuda, Kahoku (JP); Satoshi Ishida, Kahoku (JP)

(73) Assignee: PFU Limited, Ishikawa (JP)

( * ) Notice: Subject to any disclaimer, the term of this patent is extended or adjusted under 35 U.S.C. 154(b) by 347 days.

(21) Appl. No.: 11/348,265

(22) Filed: Feb. 7, 2006

(65) Prior Publication Data

US 2006/0214356 A1 Sep. 28, 2006

(30) Foreign Application Priority Data

Feb. 7, 2005 (JP) ..... P2005-030211

(51) Int. Cl.
*B65H 7/08* (2006.01)
*B65H 3/52* (2006.01)
*B65H 3/06* (2006.01)

(52) U.S. Cl. ..... 271/111; 271/121; 271/114

(58) Field of Classification Search ..... 271/122, 271/124, 125
See application file for complete search history.

(56) References Cited

U.S. PATENT DOCUMENTS 4,775,086 A * 10/1988 Kataoka ..... 226/44
5,029,837 A * 7/1991 Uchiyama ..... 271/110
5,172,900 A * 12/1992 Uno et al. ..... 271/125
5,435,540 A * 7/1995 Martin et al. ..... 271/122
5,981,006 A * 11/1999 Jaegge et al. ..... 428/34.2
6,199,854 B1 3/2001 Tranquilla et al.
6,565,079 B1 * 5/2003 Kakegawa et al. ..... 271/125
2004/0004319 A1 * 1/2004 Hattori et al. ..... 271/10.01
2004/0188916 A1 * 9/2004 Tsukamoto et al. ..... 271/110
2004/0188919 A1 9/2004 Sakamaki et al.
2004/0217541 A1 * 11/2004 Horio ..... 271/121
2005/0167460 A1 * 8/2005 Franz et al. ..... 226/24
2005/0184443 A1 * 8/2005 Satoh et al. ..... 271/10.01
2007/0257418 A1 * 11/2007 Tsukamoto et al. ..... 271/110
2007/0257422 A1 * 11/2007 Suzuki ..... 271/225

(Continued)

FOREIGN PATENT DOCUMENTS

JP 58100916 * 6/1983

(Continued)

OTHER PUBLICATIONS

German Office Action dated Mar. 21, 2007 issued with respect to the corresponding German Published Patent Application No. 10 2006 005 129.7-27.

*Primary Examiner*—Patrick H Mackey
*Assistant Examiner*—Patrick Cicchino

(57) ABSTRACT

A pick roller picks a sheet stacked in a hoper and transports the sheet toward a separating section at which a separator roller and a brake roller is provided. The separator roller and the brake roller transport the sheet one by one. A first unit is provided on the brake roller and is adapted to detect a rotation of the brake roller. A second unit is provided in the separating section and is adapted to detect a speed of the sheet. A controller is operable to determine an entry state of the sheet with respect to the separator roller based on presence or absence of the sheet in the separating section determined from the speed of the sheet in the separating section and whether or not the brake roller is rotating, and to optimally control a force acting in separation for the sheet.

8 Claims, 9 Drawing Sheets

U.S. PATENT DOCUMENTS

2007/0267802 A1* 11/2007 Kutzer ..... 271/95

FOREIGN PATENT DOCUMENTS

JP 01226645 * 9/1989
JP 01226666 * 9/1989
JP 8-188286 7/1996
JP 8-188291 7/1996
JP 2000118789 * 4/2000
JP 2001-206571 7/2001

* cited by examiner

| | | DETECTION OF ROTATION OF BRAKE ROLLER | |
|---|---|---|---|
| | | STATIONARY | ROTATING |
| DETECTION OF SHEET IN SEPARATING SECTION | ABSENT | TORQUE : NONE (STANDBY STATE) | TORQUE : LARGE (STATE PRIOR TO ENTRY) |
| | PRESENT | TORQUE : SMALL (SEPARATED STATE) | TORQUE : MEDIUM (STATE OF SINGLE SHEET BEING FED) |

ART SHEET, HIGH-HUMIDITY ENVIRONMENT

ULTRA-THIN SHEET, LOW-HUMIDITY ENVIRONMENT

SHEET FEEDER

BACKGROUND OF THE INVENTION

The present invention relates to a sheet feeder in which sheets stacked in a hopper are picked and transported into the sheet feeder, the sheets being fed one by one into the sheet feeder by a separator roller and a brake roller provided in a separating section.

In related sheet feeders used for an image reading apparatuses or the like, a system is widely used in which sheets are separated by making use of a difference between the coefficient of friction between sheets and the coefficient of friction with a separating member (a pad, a belt, or a roller).

In a sheet feeder used in a related image reading apparatus, sheets are taken out one by one by a configuration shown in FIG. 9. In a case where there are a plurality of sheets subject to reading, sheets are piled up, and are set in a hopper so that ends of the sheets are located below a pick roller. As the pick roller is rotated so as to draw the set sheets into a main body of the sheet feeder, the topmost sheet is picked by the frictional force of its portion which comes into contact with the pick roller, and is fed into the sheet feeder. At this time, there are cases where not only the topmost sheet but also a few sheets including the topmost sheet are simultaneously transported. However, an arrangement is provided such that as the thickness of a passable sheet is restricted by a feeding gate, the number of sheets which are fed into the sheet feeder is narrowed down, and only one sheet is fed into the sheet feeder by a separator roller and a brake roller.

Actually, however, since conditions change including such as the use of various types of sheet, there occur problems of faulty feeding in which the sheet cannot be transported into the sheet feeder, and overlap feeding in which a plurality of sheets are fed simultaneously. As a means for realizing a more high-performance sheet feeder, a device setting which is adjusted to the characteristics of the sheets and the setting environment of the device is very effective in terms of the diversity of the sheet characteristics. However, the present situation is such that it is difficult for a user to select a proper device setting, and there are cases where an engineer makes adjustment at the time of installation.

To overcome such problems, the following arts or apparatus are known, among others: an art in which overlap feeding is detected by the sheet thickness immediately after passing a separating section, and if a determination is made that overlap feeding has occurred, the number of reverse rotation of a reverse roller is increased (refer to JP-A-8-188286); an art in which the forwardly or reversely rotating speed of a brake belt is changed in correspondence with a processing speed (refer to U.S. Pat. No. 6,199,854); a sheet transporting device which has a means for adjusting a separating pressure in a case where the moving speed of the sheet is not within a proper range (refer to JP-A-8-188291); and an art in which the load of a braking section is changed in correspondence with the state of movement of a separating section (refer to JP-A-2001-206571).

The reviewing of the mechanism, control, and the separating member of the device itself improves the performance, if viewed from one aspect, but results in the simultaneous occurrence of demerits. For example, if the separating force is enhanced, the overlap feeding can be eliminated, but a jam increases, and the life of expendables is shortened. Furthermore, although in recent years there has been a demand for a feeding device in which different types of sheets can be loaded in a mixed form, if in this case an attempt is made to make adjustment to the characteristics of the sheet, the performance becomes deteriorated in comparison with an identical sheet type since an optimum device setting differs for each sheet.

SUMMARY

It is therefore an object of the invention is to provide a sheet feeder which is capable of mixed-form loading and free of demerits by monitoring the separated state of the sheet in real time and providing feedback control, thereby overcoming the above-described problems.

In order to achieve the object, according to the invention, there is provided a sheet feeder in which a pick roller picks a sheet stacked in a hoper and transports the sheet toward a separating section at which a separator roller and a brake roller is provided, and the separator roller and the brake roller transport the sheet one by one, the sheet feeder comprising:

- a first unit, provided on the brake roller, and adapted to detect a rotation of the brake roller;
- a second unit, provided in the separating section, and adapted to detect a speed of the sheet;
- a controller, operable to determine an entry state of the sheet with respect to the separator roller based on:
  - presence or absence of the sheet in the separating section determined from the speed of the sheet in the separating section; and
  - whether or not the brake roller is rotating, and
- to optimally control a force acting in separation for the sheet.

With this configuration, even in the case of the sheet feeder in which different types of sheets are loaded in a mixed form, the control which is adjusted to the sheet characteristics for each sheet is made possible by monitoring the separated state of the sheet in real time and providing feedback control.

The brake roller may be configured such that a rotational load of the brake roller is controllable, and the controller may control the rotational load, or a pressure applying force of the brake roller or a pressure applying force of the pick roller.

The entry state may be classified into any one of a standby state, a state prior to entry, a separated state, and a state of a single sheet being fed.

The sheet feeder may further comprise a third unit, provided on the separator roller, and adapted to detect a rotation of the separator roller. The controller may calculate a slip ratio based on a rotational speed of the separator roller and a movement amount of the sheet in the separation, and control the force acting in the separation based on the slip ratio.

The sheet feeder may further comprise a third unit, provided on the separator roller, and adapted to detect a rotation of the separator roller. The controller may calculate an integrated value of a difference between a feeding amount of the separator roller based on a rotational speed of the separator roller and a feeding amount of the brake roller based on a rotational speed of the brake roller, and cause a display to display a notification for prompting cleaning when the integrated value is equal to a prescribed value.

The sheet feeder may further comprise a third unit, provided on the separator roller, and adapted to detect a rotation of the separator roller. The controller may calculate an integrated value of a difference between a feeding amount based on a transporting speed of the sheet detected in the separating section and a feeding amount of the separator roller, and give a notification for 1s prompting replacement of the separator roller when the integrated value is equal to a prescribed value.

The sheet feeder further comprises a third unit, provided on the separator roller, and adapted to detect a rotation of the separator roller. The controller may calculate an integrated value of a difference between a feeding amount based on a transporting speed of the sheet detected in the separating section; and a feeding amount of the brake roller, and give a notification for prompting replacement of the brake roller when the integrated value is equal to a prescribed value.

A roller may be served as the second unit, the roller may be driven by the sheet while coming into contact with the sheet with a pressure of the roller smaller than a pressure of the separator roller which is imparted to the sheet, and the roller may rotate while following a contact point between the sheet and the separator roller, which varies depending on a dimension of the separator roller, environmental temperature, and a shape of the sheet.

According to the invention, there is also provided a sheet feeder comprising:

- a transporter, adapted to transport a sheet in a transport direction;
- a separator roller and a brake roller, disposed at a downstream side of the transporter in the transport direction, and forming a separating section in which the sheet is transported one by one;
- a first detector, operable to detect a rotation of the brake roller;
- a second detector, operable to detect a leading end edge of the sheet at the separating section;
- a controller, operable to determine a state of the sheet with respect to the separating section based on the detected rotation of the brake roller and the detected leading end edge of the sheet, and to control the brake roller based on the state of the sheet.

The controller may apply no torque to the brake roller in the state in which the rotation of the brake roller is not detected and the leading end edge of the sheet is not detected, the controller may apply a first torque to the brake roller in the state in which the rotation of the brake roller is detected and the leading end edge of the sheet is not detected, the controller may apply a second torque that is smaller than the first torque to the brake roller in the state in which the rotation of the brake roller is not detected and the leading end edge of the sheet is detected, and the controller may apply a third torque that is smaller than the first torque and larger than the second torque to the brake roller in the state in which the rotation of the brake roller is detected and the leading end edge of the sheet is detected.

According to the invention, there is also provided a sheet feeder comprising:

- a transporter, adapted to transport a sheet in a transport direction;
- a separator roller and a brake roller, disposed at a downstream side of the transporter in the transport direction, and forming a separating section in which the sheet is transported one by one;
- a first detector, operable to detect a rotational speed of the separator roller;
- a second detector, operable to detect displacement of the sheet at the separating section;
- a controller, operable to calculate:
  - a feeding amount of the separator roller based on the rotational speed of the separator roller; and
  - a slip ratio based on the feeding amount of the separator roller and the displacement of the sheet, and
- to control the brake roller based on the slip ratio.

The controller may apply a prescribed torque to the brake roller when the slip ratio is a prescribed value, the controller may apply a first torque larger than the prescribed torque to the brake roller when the slip ratio is smaller than the prescribed value, and the controller may apply a second torque smaller than the prescribed torque to the brake roller when the slip ratio is larger than the prescribed value.

BRIEF DESCRIPTION OF THE DRAWINGS

FIG. 1 is a diagram illustrating a sheet feeder which is used in an image reading apparatus or the like;

DETAIL DESCRIPTION OF PREFERRED EMBODIMENTS

Figure 1:
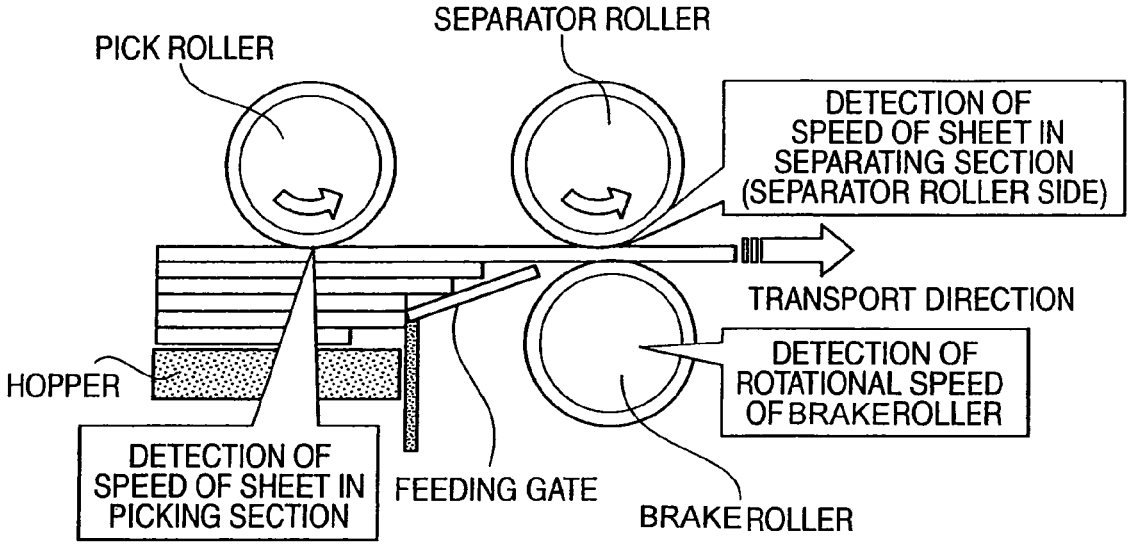

Hereafter, a description will be given of the invention on the basis of the illustrated example. A sheet feeder of FIG. 1 is used in an image reading apparatus or the like. As shown in FIG. 1, a pick roller is provided at a portion corresponding to an end portion of a hopper in which sheets are stacked, and the sheet stacked in the hopper is picked from above and is transported into the sheet feeder. At this time, there are cases where not only the topmost sheet but also a few sheets including the topmost sheet are simultaneously transported. However, an arrangement is provided such that as the thickness of a passable sheet is restricted by a feeding gate, the number of sheets which are fed into the sheet feeder is narrowed down, and only one sheet is fed into the sheet feeder by a separator roller and a brake roller.

Figure 10:
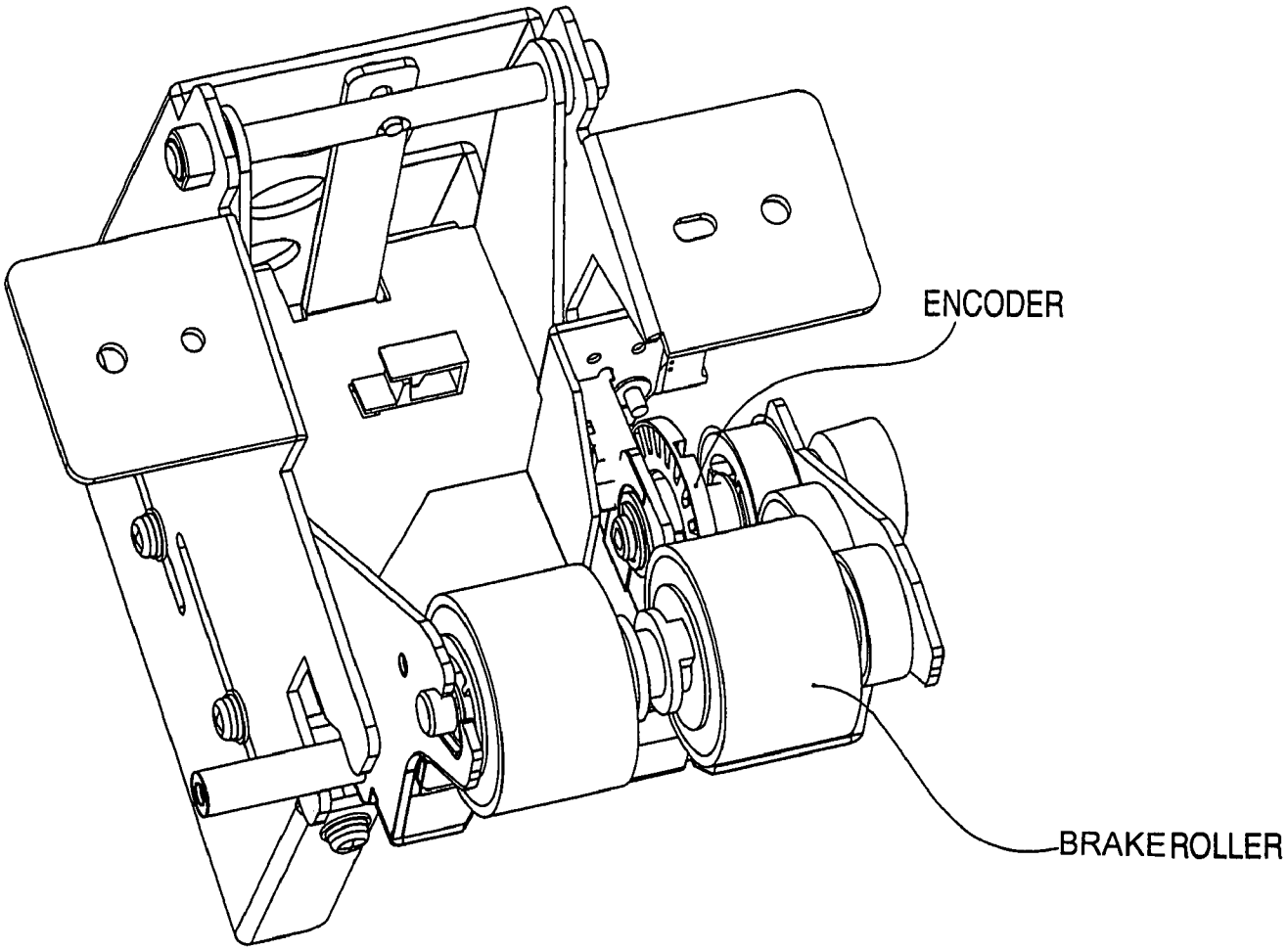
FIG. 10 is a diagram illustrating a brake roller.

The pick roller and the separator roller are driven by a motor. The separator roller and the brake roller are provided with units for detecting their rotation (see FIGS. 2 and 10). In addition, the brake roller is arranged such that its rotational load is controllable and is controlled by a controller not shown in the drawings. For example, a brake such as an electromagnetic brake can be coupled to a roller shaft, and the brake torque can be controlled by rendering an electric current flowing across it variable. Alternatively, the pressure applying force of the brake roller may be controlled, or the picking pressure (pressure applying force) of the pick roller may be controlled by the controller.

Figure 2:
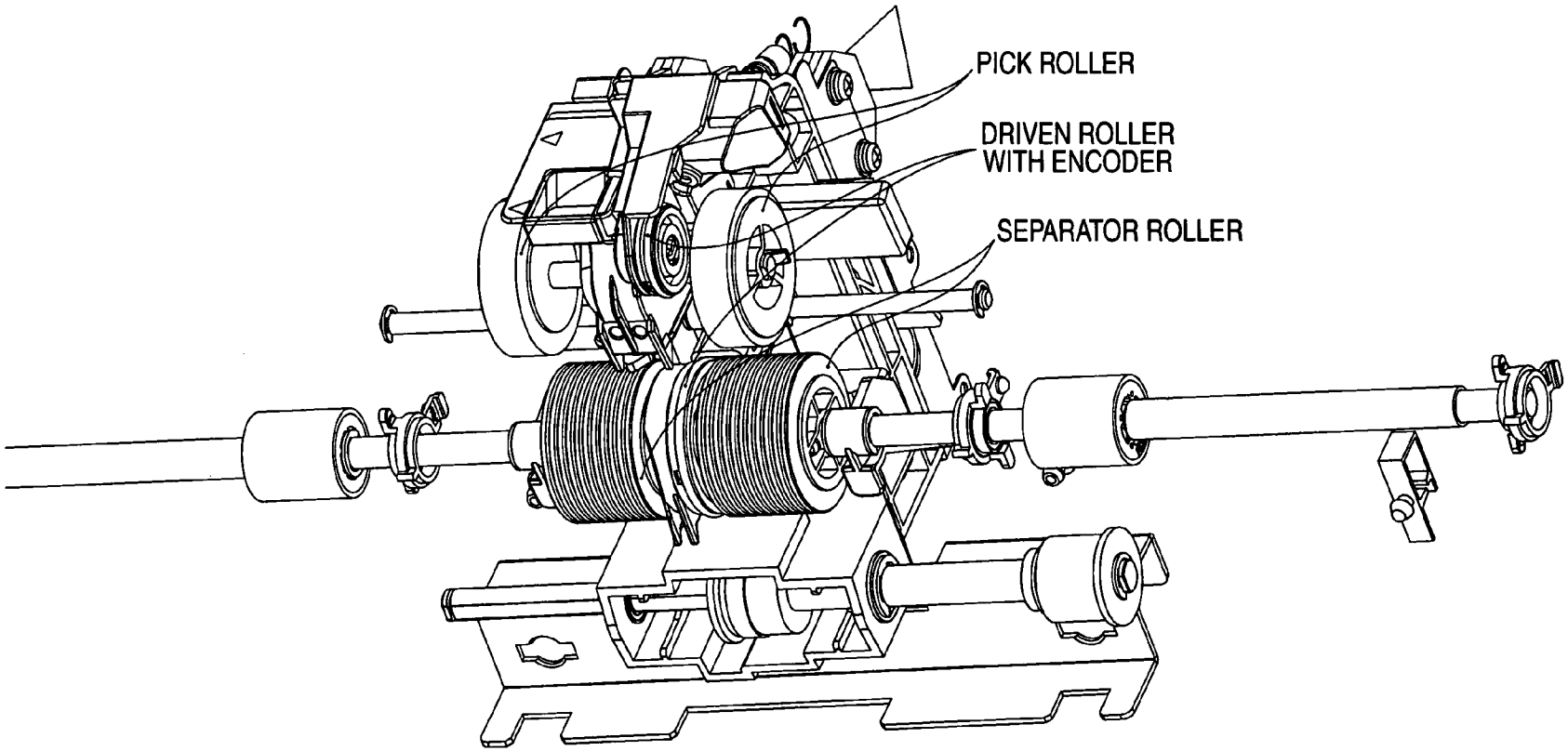
FIG. 2 is a diagram in which a pick roller and a separator roller are viewed from the sheet contacting side.

A unit (encoder) for detecting the sheet is provided in a separating section (including the separator roller and the brake roller). In addition, the unit (encoder) for detecting the sheet can be provided in a picking section (including the pick roller) as well. As shown in FIG. 2, each of the illustrated pick roller and separator roller has two rollers divided into two in the axial direction and fixed on the same drive shaft. Driven rollers, which rotate in contact with the sheet and in correspondence with the movement of the sheet, are each provided between these divided rollers of the pick roller and the separator roller. The driven rollers are driven by the sheet. The driven rollers are non-loaded, and are supported so as to be freely rotatable about the drive shafts of the pick roller and the separator roller, respectively. As the driven rollers, rollers are used which have such a small rotational load that they are driven while coming into contact with the sheet with a smaller pressure than a pressure of a transporting means (the pick roller or the separator roller) which is imparted to the sheet, and rotate by following a sheet contact height (contact point between the sheet and the transporting means) which changes due to such as a change in the dimensions of the transporting means, a change in the environmental temperature, and a change in the shape of the sheet.

The rotational speed of the driven roller can be detected by the encoder attached to the driven roller. Transporting speeds of the sheet in the picking section and the separating section can be respectively calculated from the rotational speed and the diameter of the driven roller, and a movement amount of the sheet can be calculated by integrating them, by the controller. In addition, the presence or absence of the sheet in the separating section, i.e., a leading end edge of the sheet, can be detected by whether or not the driven roller provided in the separating section is rotating. Furthermore, by detecting the rotational speed of the separator roller, a feeding amount of the roller can be calculated from this rotational speed and the diameter of the roller by the controller, so that the controller can calculate a slip ratio which is the difference between this feeding amount of the roller and the movement amount of the sheet detected by the driven roller.

In addition, by making use of the fact that rotational speed detecting units (encoders) are respectively provided on the separator roller and the brake roller (shown in FIGS. 2 and 10), it is possible to give a notification for prompting cleaning in the sheet feeder (e.g. the separator roller and the brake roller) to a user in a case where an integrated value of the difference between the feeding amounts of the both rollers (the separator roller and the brake roller) is equal to a prescribed value. The controller causes a display that is not shown in the drawings to display the notification for prompting cleaning. Furthermore, by making use of the fact that the separating section is provided with the driven roller having the unit for detecting the transporting speed of the sheet, it is possible to give a notification for prompting replacement of the separator roller and the brake roller to a user in a case where an integrated value of the difference between the feeding amount of the sheet being transported and each of the feeding amounts of the separator roller and the brake roller is equal to a prescribed value. The controller causes the display to display the notification for prompting the replacement.

In the invention, the force acting in separation of the sheet is optimally controlled by the controller, such as by controlling the rotational load of the brake roller, or its pressure applying force or the picking pressure, on the basis of the presence or absence of the sheet in the separating section or the slip ratio in the separating section. Hereafter, a further description will be given by citing as an example a case in which the brake torque of the brake roller is controlled.

Figures 4, 5:
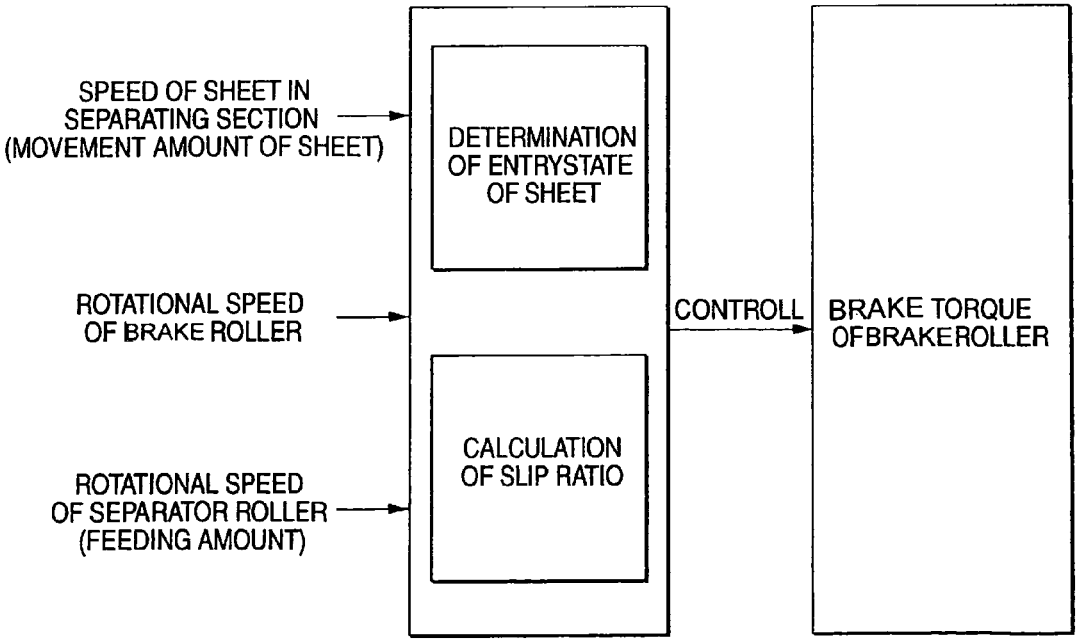
FIG. 4 is a table explaining the torque required on the basis of the feeding state.
FIG. 5 is a schematic diagram illustrating the brake torque control in accordance with the invention.

As shown in FIG. 5, an entry state of the sheet into the separating section (feeding state) can be determined by the presence or absence of the sheet in the separating section (presence or absence of the detection of the sheet speed) and by the detection of the rotation of the brake roller by the controller. Further, this feeding state can be classified into finer states by adding information of the movement amount of the sheet concerning the actual transport of the sheet after detection of the leading end edge of the sheet. The brake torque of the brake roller is optimally controlled by the controller, on the basis of this feeding state, i.e., the entry state of the sheet.

In addition, if the rotational speed of the separator roller is detected, the feeding amount of the roller can be calculated from this rotational speed and the diameter of the roller, so that the difference (slip ratio) between this feeding amount of the roller and the movement amount of the sheet detected by the driven roller is calculated by the controller. The state of slip is thereby detected, and the brake torque of the brake roller is controlled by the controller.

Figure 3A:
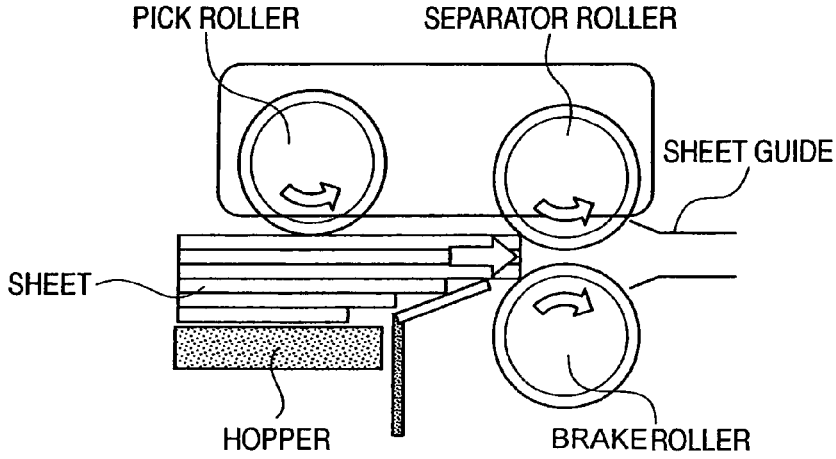
FIGS. 3A to 3C are diagrams explaining control of the brake torque of the brake roller upon detecting a feeding state.

FIG. 3A illustrates a state prior to the entry of the sheet into the separating section. During standby, the pick roller and the separator roller are not driven, and neither the brake roller rotates (a standby state). FIG. 3A shows a state (a state prior to entry) in which the pick roller and the separator roller in the standby state have now been driven, and the sheet has reached a position where it is brought into contact with the separator roller and the brake roller. Up until this state, the brake roller rotates at high speed while coming into direct contact with the separator roller. The rotation of the brake roller is detected by the rotation detecting unit attached thereto. At this time, there is a possibility of a plurality of sheets entering, so that the brake torque of the brake roller is controlled to a maximum to suddenly stop the brake roller.

Figure 3B:
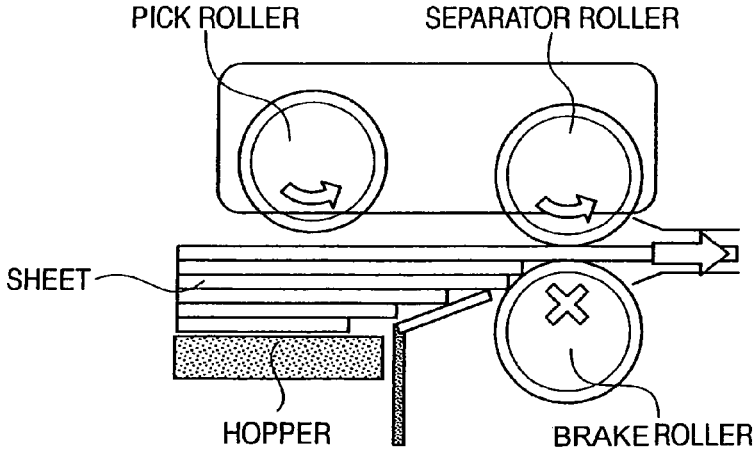

FIG. 3B is a diagram explaining the brake torque control of the brake roller during the separation of the sheet. Although the topmost sheet is being transported from the separating section into the sheet feeder, a second sheet has reached the brake roller (a separated state). In this state, it is necessary to prevent the entry of the second sheet which has reached the brake roller and is stopped, but since the second sheet slips with respect to the topmost sheet, the brake roller remains in a stationary state. It is sufficient for the brake roller if this stationary state can be maintained, so that the brake torque can be made small. It is undesirable to make the brake torque unnecessarily large, since it leads to an unnecessary increase in the load of the separator roller.

Figure 3C:
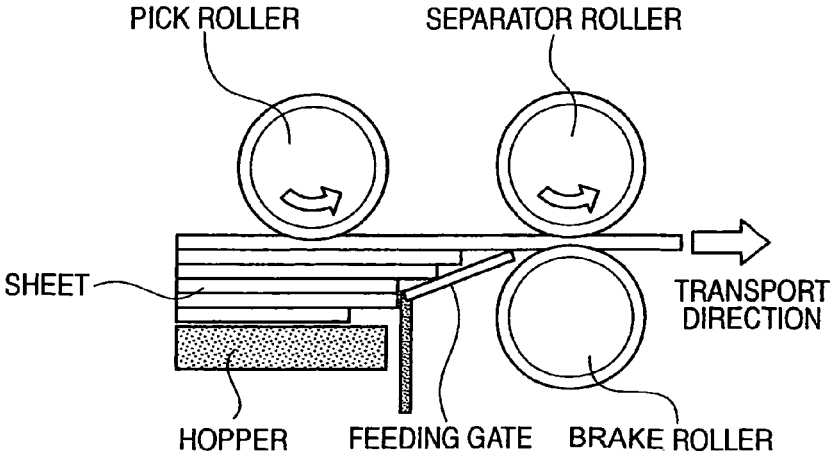

FIG. 3C is a diagram explaining the brake torque control of the brake roller during the transport of the sheet. The brake roller is applying a brake to the separator roller while nipping one sheet therebetween (a state of a shingle sheet being fed). Since the brake roller nips the sheet between the same and the separator roller, and is more likely to slip than in the case where the brake roller is in direct contact with the separator roller, the brake torque required is at a medium level.

FIG. 4 is a table which sums up the above explanation. The feeding state can be determined by detecting the presence or absence of the sheet in the separating section and the rotation of the brake roller. On the basis of this feeding state, the brake torque of the brake roller is optimally controlled by the controller.

Figure 6A:
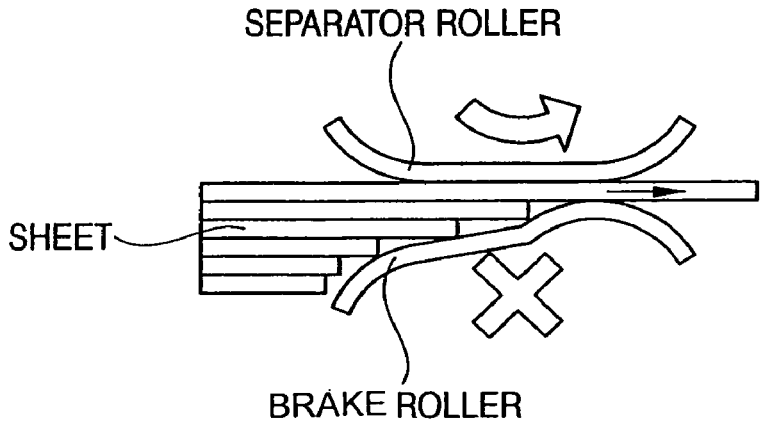
FIGS. 6A and 6B are diagrams explaining the brake torque control of the brake roller upon detecting the state of slip.

FIG. 6A is a diagram explaining the control in a case where the slip is small. The slip is small in a case where art sheet or the like is used or in a high-humidity environment, for example. In the case of such sheet, there is an advantage in which the entry of the sheet is facilitated, but the second and third sheets also enter the separating section by being adhered to the topmost sheet. Since the brake roller comes into contact with the second sheet as well, the transporting load of the separator roller is alleviated. In this case, the entry of the second sheet is prevented by providing control so that the brake torque becomes large. The mark "x" in the drawings indicates that the brake roller is stopped.

Figure 6B:
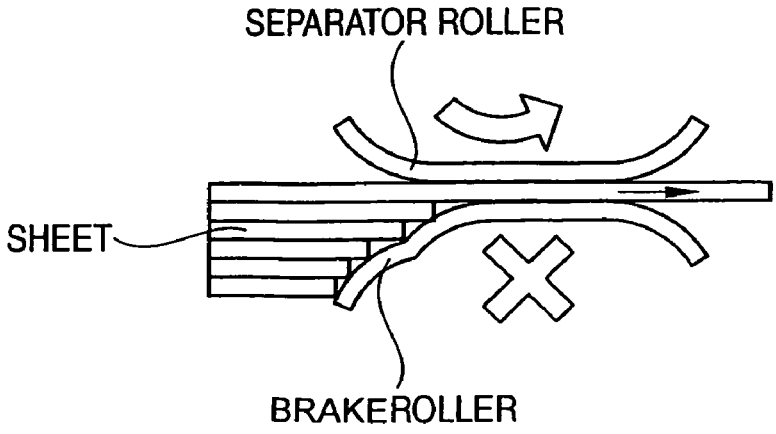

FIG. 6B is a diagram explaining the control in a case where the slip is large. The slip is large in a case where ultra-thin sheet or the like is used or in a low-humidity environment, for example. In the case of such sheet, the entry of the sheet is difficult. However, the sheets tend not to stick together, and the second sheet tends to stop in front of the separating section. Since the brake roller comes into contact with the separator roller with only one sheet nipped therebetween, the transporting load of the separator roller is large. In this case, the transporting load is alleviated by providing control so that the brake torque becomes small.

Figure 7:
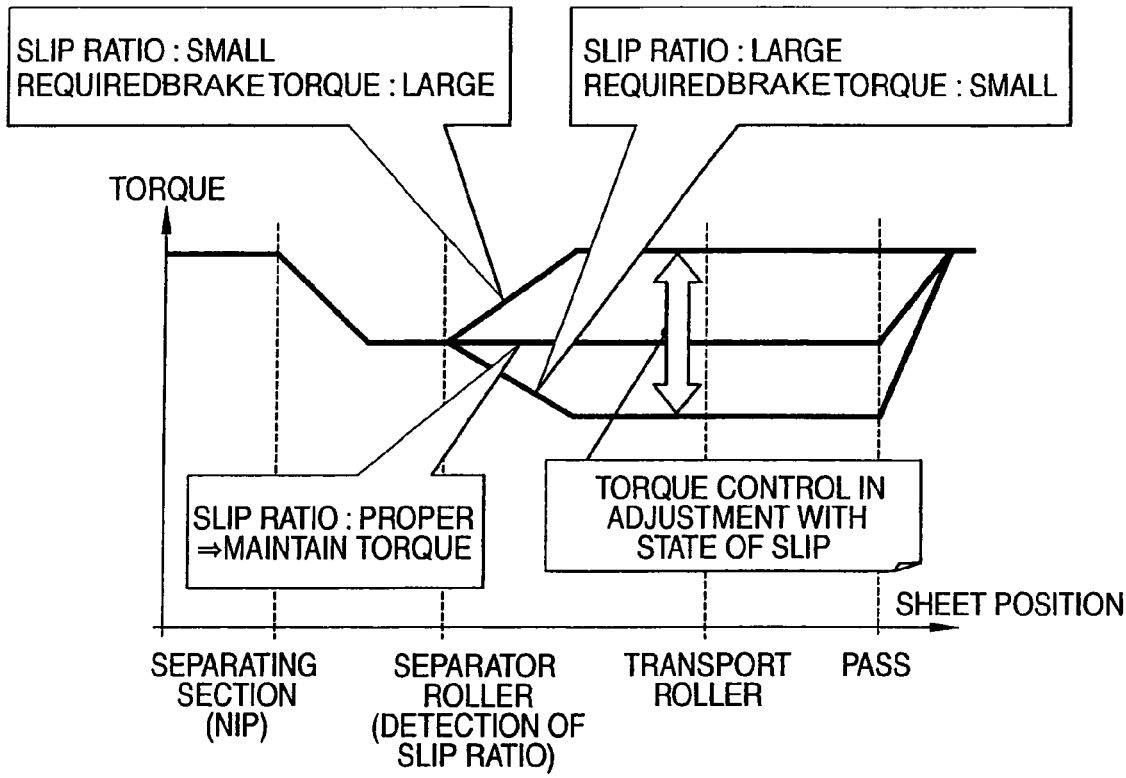
FIG. 7 is a graph which sums up the brake torque control described with reference to FIGS. 6A and 6B.

In FIG. 7, the abscissa represents the sheet position, and the ordinate represents the brake torque. As shown in FIG. 7, the brake torque for the separating section is set to large torque, and upon detection of the sheet being transported the brake torque is set to medium torque. Subsequently, as described with reference to FIGS. 6A and 6B, the slip ratio is detected at the separator roller, and on the basis of this slip ratio the torque control is performed for making the brake torque large or small. After it is detected that the sheet has passed a transport roller (a transporting section) located further ahead (at a downstream side) of the separator roller, the control of the brake torque based on the slip ratio is finished.

Figure 8:
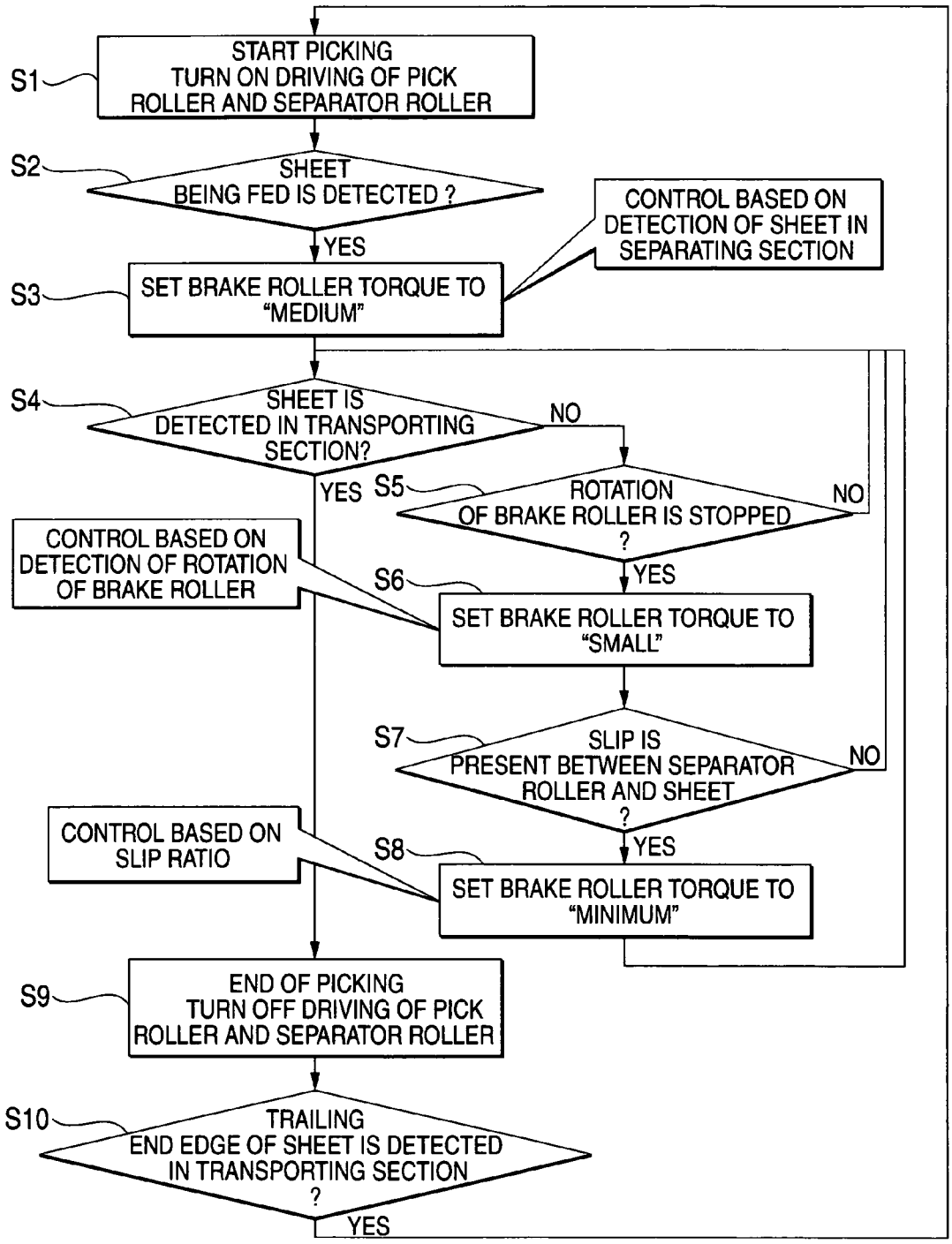
FIG. 8 is a diagram illustrating an operation sequence of optimization control of the brake torque.
Figure 9:
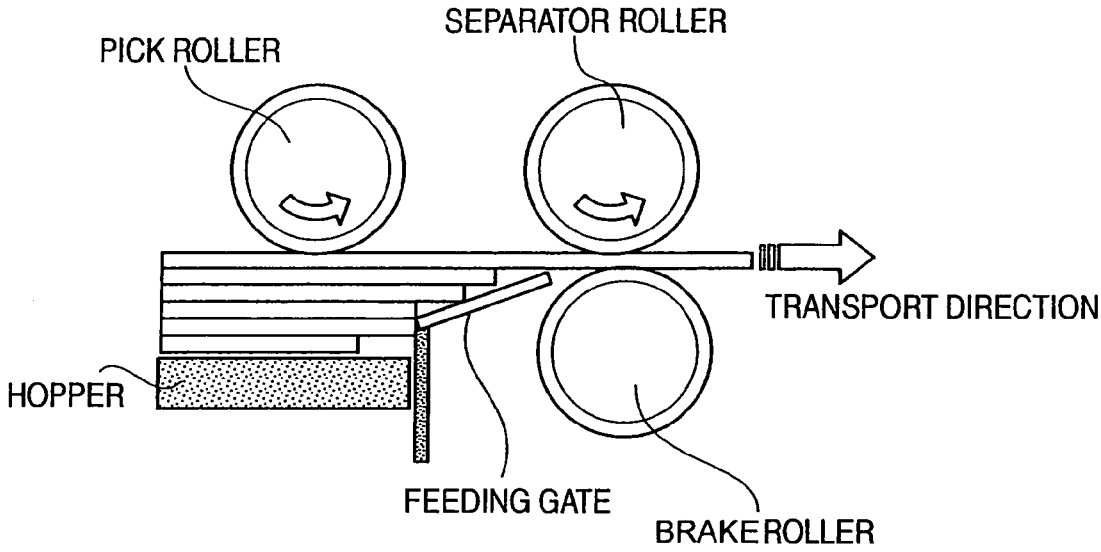
FIG. 9 is a diagram illustrating a sheet feeder used in a related image reading apparatus.

In FIG. 8, first, in Step S1, picking is started, and the pick roller and the separator roller are driven. The subsequent control is performed as described above with reference to FIGS. 3A to 3C. Then, a determination is made as to whether or not the sheet is being transported on the basis of the detection of the sheet in the separating section and the detection of the rotation of the brake roller (S2). Upon detection of the sheet being transported, the brake roller torque is set to "medium," as described above (S3). Next, a determination is made as to whether or not the sheet detection has been effected in the transporting section (S4). The transporting section is formed by being provided with the transport roller located at a position further ahead of the separator roller.

Unless the sheet is detected by the transporting section, the operation enters a loop which starts with Step S5. In Step S5, a determination is made as to whether or not the rotation of the brake roller is stopped. If the rotation is not stopped, the operation returns to Step S4. If the rotation is stopped, the brake roller torque is set to "small." Next, a determination is made as to whether or not slip is present between the separator roller and the sheet (S7). If the slip is absent, the operation returns to Step S4. If the slip is present, the brake roller torque is set to "minimum" (S8), and the operation returns to Step S4.

If the sheet is detected by the transporting section, the picking is finished, and the driving of the pick roller and the separator roller is turned off (S9). Then, a determination is made as to whether or not a trailing end edge of the sheet has been detected by the transporting section (S10), and if it has been detected, the operation returns to Step S1.

What is claimed is:

1. A sheet feeder in which a pick roller picks a sheet stacked in a hopper and transports the sheet toward a separating section at which a separator roller and a brake roller are provided, and the separator roller and the brake roller transport the sheet one by one, the sheet feeder comprising:

a first unit, provided on the brake roller, and to detect a rotational speed of the brake roller;

a second unit, provided in the separating section, to detect a speed of the sheet;

a third unit, provided on the separator roller, to detect a rotational speed of the separator roller, and a controller, to determine an entry state and to calculate a slip ratio of the sheet with respect to the separator roller based on:

the speed of the sheet in the separating section, the rotational speed of the separator roller, and the rotational speed of the brake roller, and to optimally control a force acting in separation for the sheet according to the entry state and the calculated slip ratio.

2. The sheet feeder according to claim 1, wherein the brake roller is configured such that a rotational load of the brake roller is controllable, and the controller controls:

the rotational load, or a pressure applying force of the brake roller or a pressure applying force of the pick roller.

3. The sheet feeding device according to claim 1, wherein the entry state is classified into any one of a standby state, a state prior to entry, a separated state, and a state of a single sheet being fed.

4. The sheet feeder according to claim 1, wherein the controller calculates an integrated value of a difference between:

a feeding amount of the separator roller based on the rotational speed of the separator roller; and a feeding amount of the brake roller based on the rotational speed of the brake roller, and gives a notification for prompting cleaning when the integrated value is equal to a prescribed value.

5. The sheet feeder according to claim 1, wherein the controller calculates an integrated value of a difference between:

a feeding amount based on the transporting speed of the sheet detected in the separating section; and a feeding amount of the separator roller, and gives a notification for prompting replacement of the separator roller when the integrated value is equal to a prescribed value.

6. The sheet feeder according to claim 1, wherein the controller calculates an integrated value of a difference between:

a feeding amount based on a transporting speed of the sheet detected in the separating section; and a feeding amount of the brake roller, and gives a notification for prompting replacement of the brake roller when the integrated value is equal to a prescribed value.

7. The sheet feeder according to claim 1, wherein the second unit is a roller, the roller is driven by the sheet while coming into contact with the sheet with a pressure of the roller smaller than a pressure of the separator roller which is imparted to the sheet, and the roller rotates while following a contact point between the sheet and the separator roller, which varies depending on a dimension of the separator roller, environmental temperature, and a shape of the sheet.

8. A sheet feeder comprising:

a transporter, adapted to transport a sheet in a transport direction;

a separator roller and a brake roller, disposed at a downstream side of the transporter in the transport direction, and forming a separating section in which the sheet is transported one by one;

a first detector, operable to detect a rotation of the brake roller;

a second detector, operable to detect a leading end edge of the sheet at the separating section;

a controller, operable to determine a state of the sheet with respect to the separating section based on the detected rotation of the brake roller and the detected leading end edge of the sheet, and to control the brake roller based on the state of the sheet wherein the controller applies no torque to the brake roller in the state in which the rotation of the brake roller is not detected and the leading end edge of the sheet is not detected, the controller applies a first torque to the brake roller in the state in which the rotation of the brake roller is detected and the leading end edge of the sheet is not detected, the controller applies a second torque that is smaller than the first torque to the brake roller in the state in which the rotation of the brake roller is not detected and the leading end edge of the sheet is detected, and the controller applies a third torque that is smaller than the first torque and larger than the second torque to the brake roller in the state in which the rotation of the brake roller is detected and the leading end edge of the sheet is detected.

* * * * *

UNITED STATES PATENT AND TRADEMARK OFFICE

CERTIFICATE OF CORRECTION

PATENT NO. : 7,658,374 B2
APPLICATION NO. : 11/348265
DATED : February 9, 2010
INVENTOR(S) : Ryoichi Yasukawa et al.

It is certified that error appears in the above-identified patent and that said Letters Patent is hereby corrected as shown below:

On the Title Page
Item (56), U.S. Patent Documents, under
"5,172,900 A * 12/1992 Uno et al. .....271/125" insert
--5,342,037 08/1994 Martin--.

Item (57) (Abstract), Line 1, change "hoper" to --hopper--.

Column 8, Line 11, change "feeding device" to --feeder--.

Signed and Sealed this

First Day of June, 2010

David J. Kappos

David J. Kappos
*Director of the United States Patent and Trademark Office*